United States Patent [19]

Henley

[11] Patent Number: 4,828,262

[45] Date of Patent: May 9, 1989

[54] BALL HITTING PRACTICE DEVICE

[76] Inventor: Douglas R. Henley, Rte. 1, Box 166, Chunky, Miss. 39323

[21] Appl. No.: 59,526

[22] Filed: Jun. 8, 1987

Related U.S. Application Data

[63] Continuation-in-part of Ser. No. 846,251, Jan. 4, 1986, abandoned.

[51] Int. Cl.[4] ..... A63B 69/40

[52] U.S. Cl. ..... 273/26 E; 273/29 A; 273/413; 273/DIG. 24

[58] Field of Search ..... 273/26 E, 29 A, 181 F, 273/181 J, 35 R, 184 B, 185 C, 196, 197 R, 197 A, 319, 331, 407, 410, 413

[56] References Cited

U.S. PATENT DOCUMENTS

| | | | |
|---|---|---|---|
| D. 20,187 | 10/1890 | Herrick | 273/58 C |
| 280,807 | 7/1883 | Farley | 273/DIG. 2 X |
| 2,058,277 | 10/1936 | Walther | 273/26 E |
| 2,568,279 | 9/1951 | Franz et al. | 273/413 |
| 2,839,300 | 6/1958 | Blaha et al. | 273/26 E |
| 2,976,041 | 3/1961 | Bales | 273/26 E |
| 3,006,647 | 10/1961 | Haskett | 273/26 E |
| 3,341,200 | 9/1967 | Brandley | 273/26 E |
| 3,366,383 | 1/1968 | Lentine | 273/26 E |
| 3,442,510 | 5/1969 | Sorensen | 273/26 E |
| 3,547,437 | 12/1970 | Anderson | 273/26 E |
| 3,594,998 | 7/1971 | Pattyn | 273/58 C |
| 3,716,235 | 2/1973 | Yerkie, Jr. | 273/26 E |
| 3,829,093 | 8/1974 | Abrams | 273/413 |
| 3,893,669 | 7/1975 | Myers | 273/26 E |
| 3,994,494 | 11/1976 | Kelley | 273/26 E |
| 4,170,352 | 10/1979 | Veola | 273/29 A |
| 4,706,964 | 11/1987 | Genovese | 273/26 E |

*Primary Examiner*—Richard C. Pinkham
*Assistant Examiner*—T. Brown
*Attorney, Agent, or Firm*—Nixon & Vanderhye

[57] ABSTRACT

A ball hitting practice device including a supporting base, a vertical support post, and an elongated support bar pivotally attached to the support post for movement between operative and inoperative positions. A protective net is supported in cantilevered relationship to the elongated support bar so that a major portion of the net extends downwardly toward the ground at a distance away from the support bar. A ball, which may be a baseball, softfall or tennis ball is suspended by means of a cable from the elongatged support bar, and is provided with a visual indicator, such as a fluorescent stripe about its middle portion, to aid the user of the device. The cable may also be provided with a kinetic energy damping device to more effectively control the ball and to reduce the interval between successive swings at the ball.

29 Claims, 6 Drawing Sheets

FIG. 1
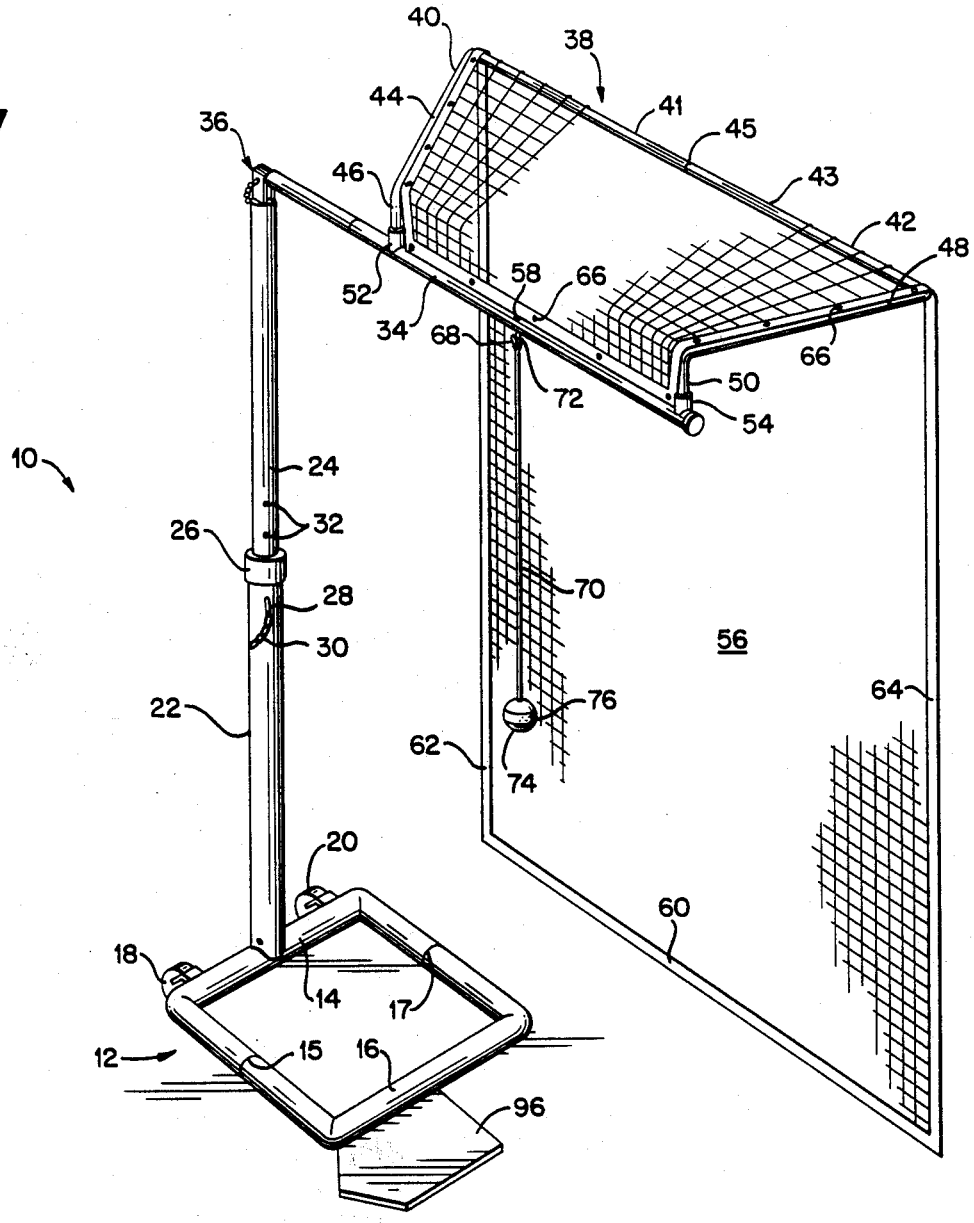
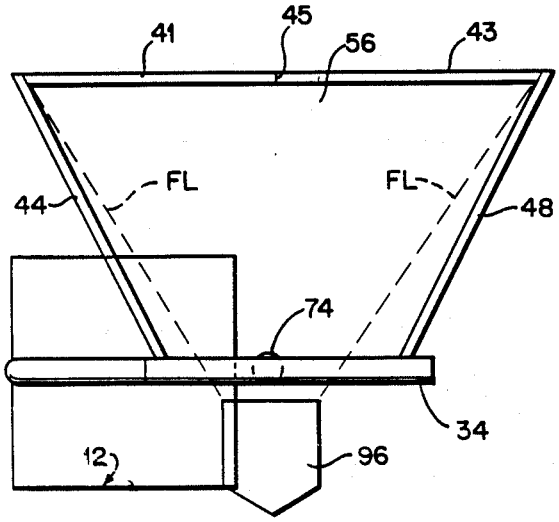
FIG. 2

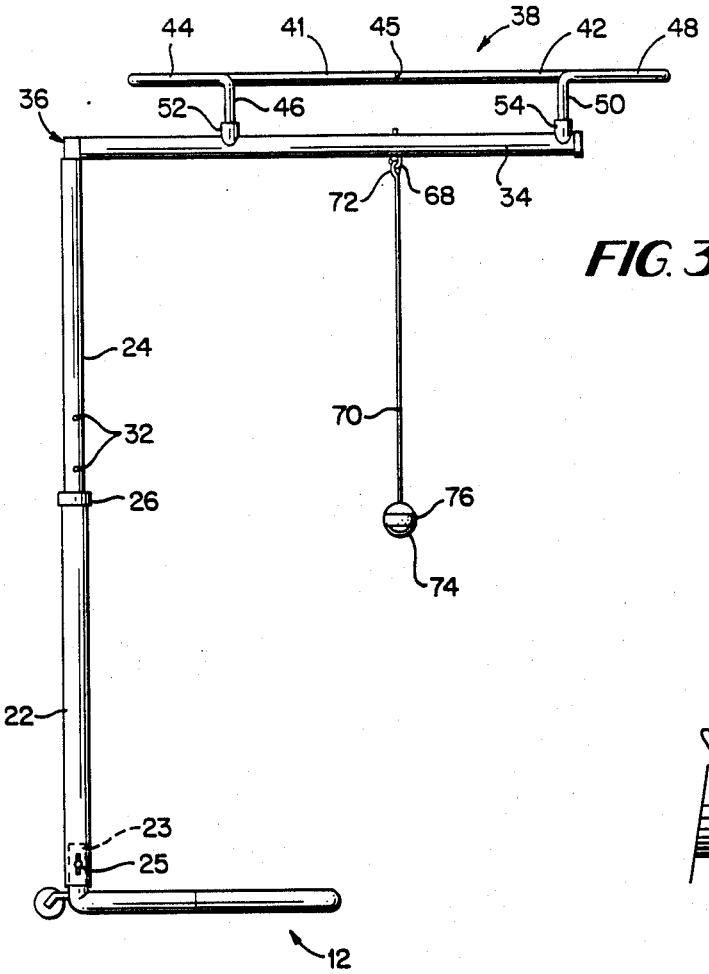
FIG. 3
FIG. 4
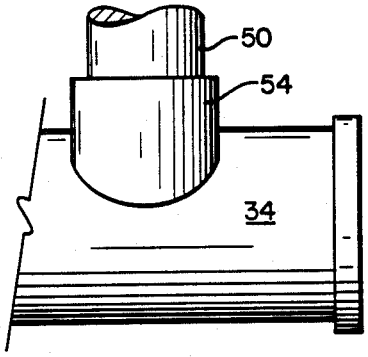
FIG. 7
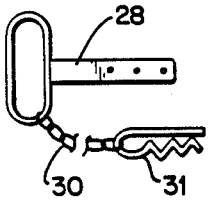
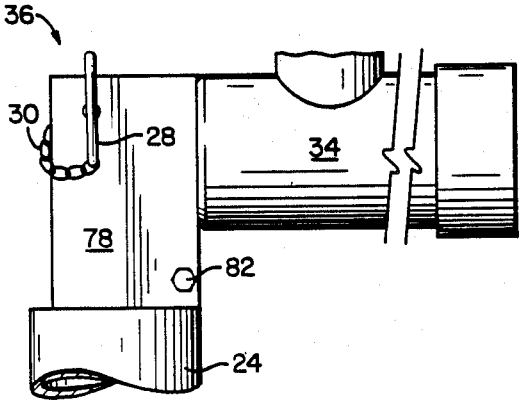
FIG. 6a
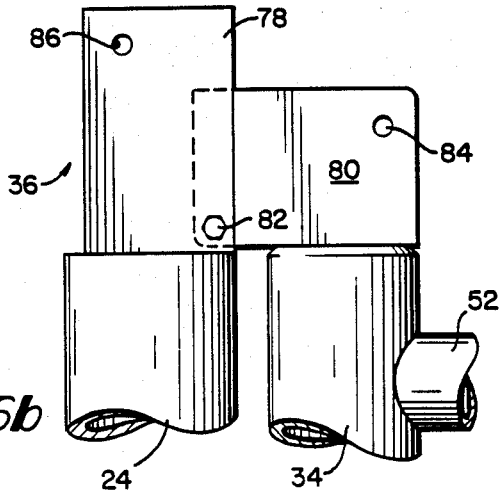
FIG. 6b

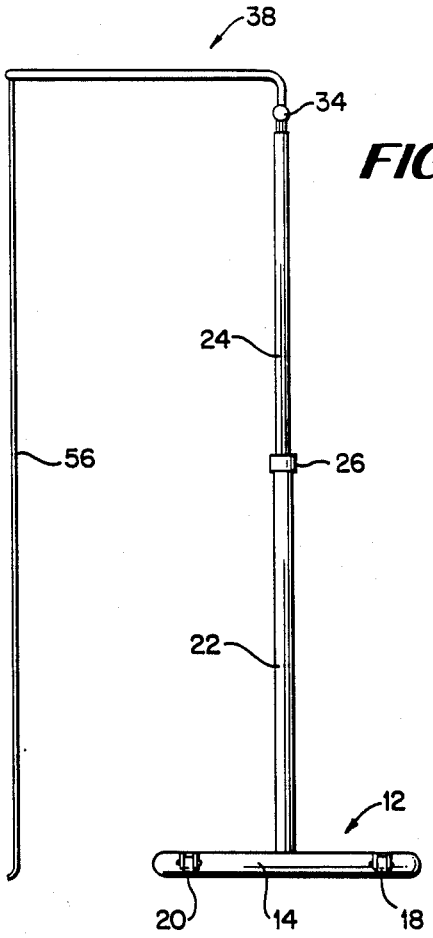
FIG. 5
FIG. 8
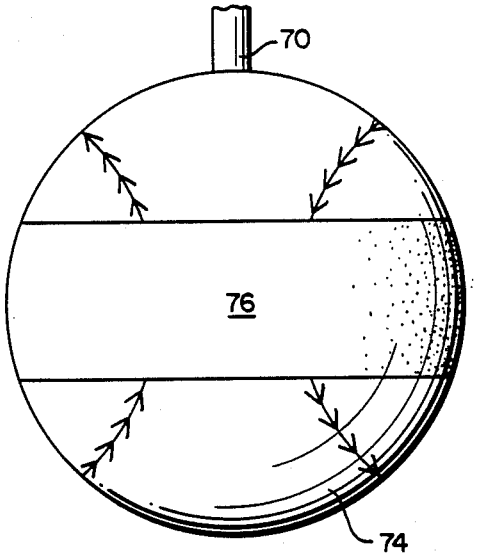
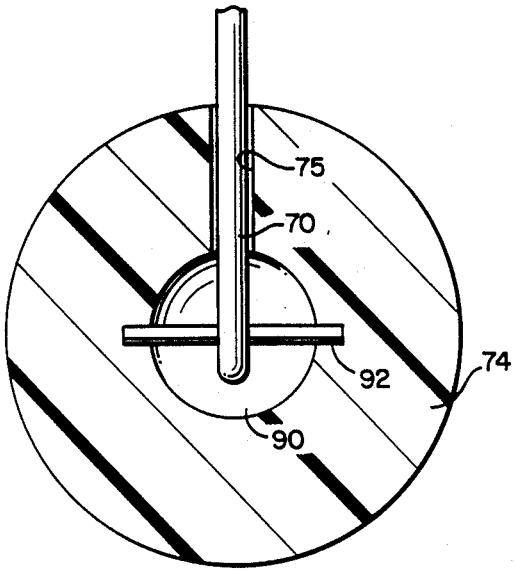
FIG. 9
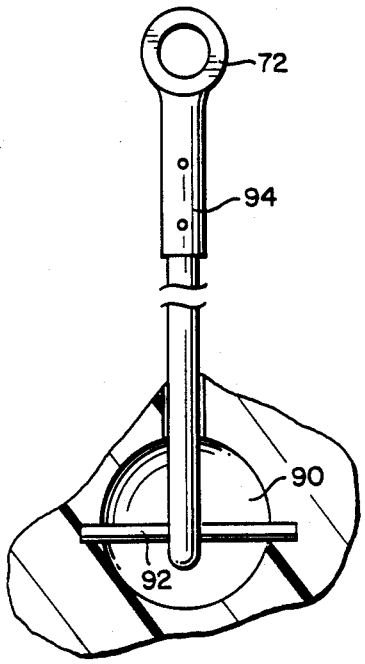
FIG. 10

FIG. 11
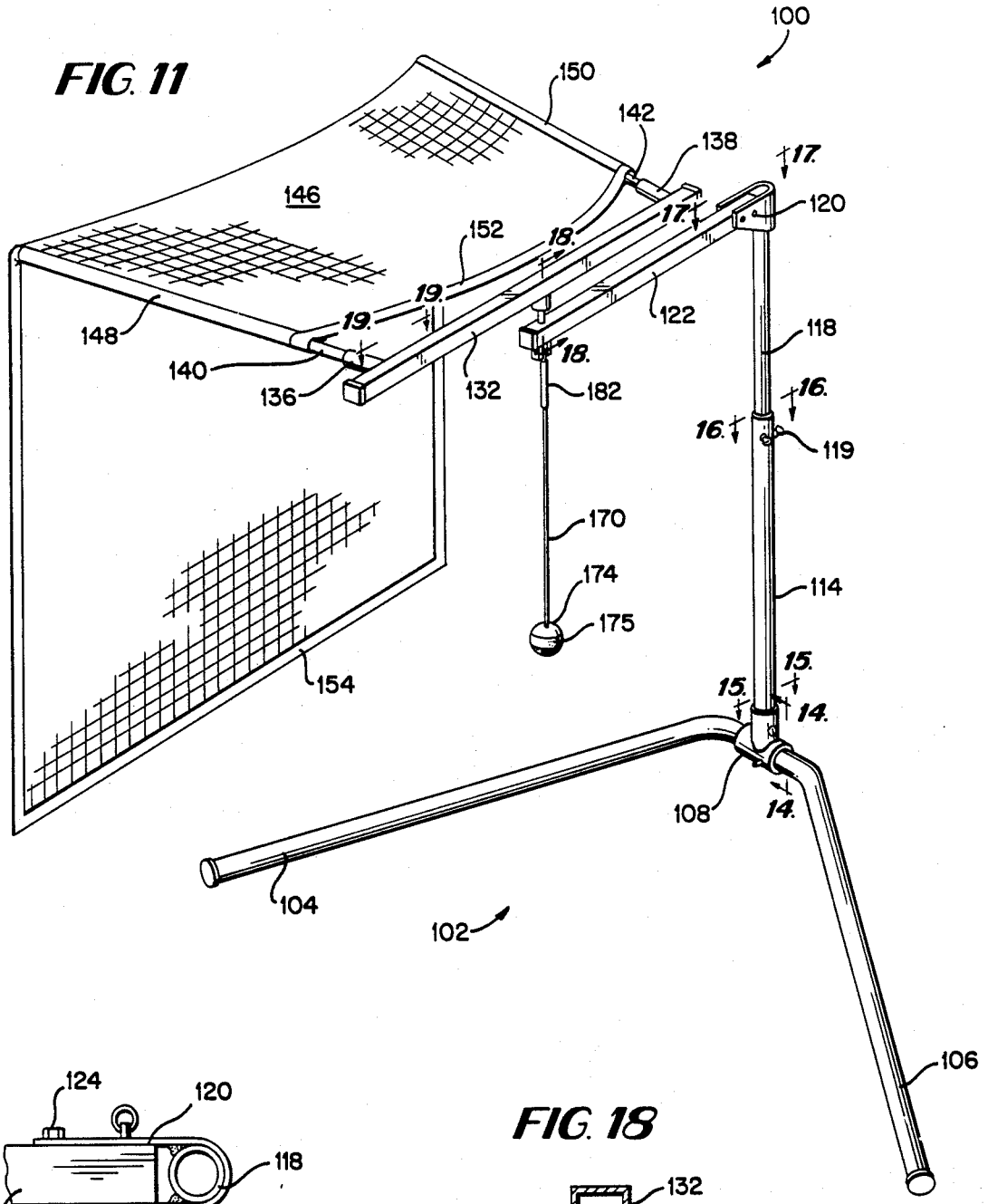
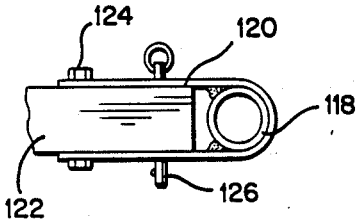
FIG. 17
FIG. 18
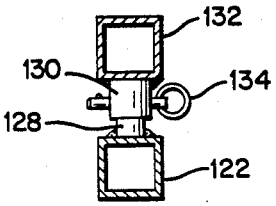
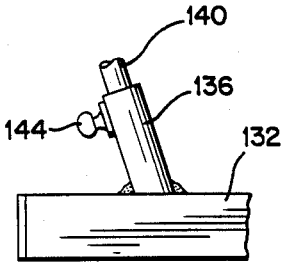
FIG. 19

BALL HITTING PRACTICE DEVICE

RELATED APPLICATIONS

This is a continuation-in-part of my co-pending application Ser. No. 846,251, filed Jan. 4, 1986, now abandoned.

BACKGROUND AND SUMMARY OF THE INVENTION

This invention relates to a ball hitting practice device designed primarily for baseball and softball players, but also for others such as tennis players, for whom hand-/eye coordination and the location of the impact with the ball when it is struck is of paramount importance.

There are, of course, many baseball batting practice devices in the prior art such as those disclosed in U.S. Pat. Nos. 3,994,494; 3,006,647; and 2,839,300. The prior art devices, however, are not completely satisfactory in all respects and do not provide the same flexibility, portability and overall advantages of the present invention.

This invention is designed to be utilized in conjunction with traditional methods of team batting practice as an aid in developing individual hitting skills. The unique design of the present invention facilitates proper development and improvement of fundamental hitting mechanics at all levels of skill and age.

The device is also designed for use by a player on his own time, at home, for example, so as to provide more frequent opportunities to concentrate on development of his own ability without requiring someone else to feed, or pitch, the balls, and still other players to retrieve them. The inherent flexibility of the invention allows the player to use the device indoors or outdoors, in confined areas, without danger to the user or to other persons or property in adjacent areas.

In a related aspect, the present invention can be converted easily for use by either right or left handed hitters through simple adjustments.

The invention is further characterized by great portability and flexibility in that the unit is of lightweight construction and can be easily disassembled for transport and/or storage purposes.

In addition, the present invention is more economical than conventional pitching machines and is therefore more available to a significantly greater number of potential users.

According to one embodiment of the invention, the hitting practice device includes a closed, tubular, ground engaging support stand which mounts a vertically adjustable support post. A support bar is mounted at the upper end of the vertical support post for movement between an operative position wherein the support bar extends substantially horizontally away from the support post, and a second inoperative position wherein the elongated support bar extends substantially parallel to the vertical support post for transport and storage purposes. In its operative position, the support bar mounts a frame which supports a protective net such that a major portion of the net extends generally vertically toward the ground at a predetermined location in front of the hitter.

A baseball (or softball, or tennis ball) of regulation size and weight, is suspended from the elongated support bar via a steel cable such that when the baseball is hit, it is caught, or absorbed in the protective net which dampens the kinetic energy of the ball, and thereafter returns it toward the batter for a subsequent hitting stroke.

In this first embodiment, the net supporting frame includes a pair of arms connected at first ends to the elongated support bar, and at second ends to each other to define a closed, generally trapezoidal shaped frame. The frame supports the net in a cantilevered arrangement with respect to the elongated support bar. The frame may be removed from the bar, turned 180°, and reattached to the bar so that, in conjunction with relocation of the device, it may be used by hitter of the opposite hand.

In another exemplary embodiment of the invention, the base structure of the device includes a pair of tubular members arranged in a generally truncated V-shaped configuration, connected to one another within a horizontally extending bore of an inverted T-shaped coupling member. Both leg portions of the support stand, as well as a vertically adjustable support post received within a vertical bore in the T-shaped coupling, are easily disassembled from the coupling member. As in the first embodiment, an elongated support bar is mounted to the vertical post for pivotal movement between operative and inoperative positions. In this second embodiment, however, the net is supported by a separate, elongated frame member which is mounted to the elongated support bar for selective, pivotal movement between positions on opposite sides of the device so that this embodiment may also be adapted for use by either left- or right-handed hitters. The elongated frame member is provided with tubular stubs at either end which receive net supporting arms extending away from the elongated support bar. As in the first embodiment, a major portion of the net extends vertically toward the ground at a position laterally spaced away from the elongated support bar, and in front of the hitter.

In this second embodiment, like the first embodiment, a baseball or softball of regulation size and weight, is suspended from the elongated support bar by means of a steel cable. A rubber sleeve is arranged at the upper end of the cable, where the latter is attached to the support bar. This arrangement facilitates the absorption of the kinetic energy and assures a shorter time interval between swings at the ball.

In both embodiments, the ball (whether it be a baseball or softball) is provided with a visual indicator, preferably in the form of a fluorescent stripe about the middle one-third of the ball. Since contact with the middle third of the ball is the primary objective of the hitter, this arrangement provides a striking visual contrast which causes the hitter's mind to subconsciously store in a priority manner the middle third of the baseball. After repetitious use of the batting practice device of this invention, there will be an increased ability to recall the middle third of the baseball without causing the hitter to engage in a prolonged thought process. In other words, the visual impression experienced by the player in practice reduces any delayed reaction in actual game conditions and improves the timing and coordination of events necessary to make solid contact with, for example, an oncoming, pitched baseball.

It will be appreciated that a regulation size and weight tennis ball may also be used in conjunction with the device for us by tennis players, and that a similar visual indicator will be employed in conjunction therewith.

The protective net utilized with the subject invention is designed to absorb the kinetic energy of the ball upon impact. In this regard, the net construction, including mesh size, is such that the net is heavy enough so that it will not flip back over the top of the device when struck, but light enough to swing outwardly a sufficient distance to allow complete follow through of the hitting stroke without interference.

It will thus be seen that the present invention provides a practice device which is useful in the development of fundamental hitting skills, and which is relatively inexpensive, flexible, safe, easy to use and fully portable.

Other objects and advantages of the subject invention will become apparent upon inspection of the detailed description of the invention which follows.

BRIEF DESCRIPTION OF THE DRAWINGS

FIG. 1 is a perspective view of a hitting practice device in accordance with one embodiment of this invention:

FIG. 2 is a top view of the device illustrated in FIG. 1, but in partially schematic form;

FIG. 3 is a front view of the device illustrated in FIG. 1 wherein the protective net has been removed;

FIG. 4 is an enlarged detail of a portion of FIG. 3 illustrating a coupling arrangement between a net frame member and a horizontal support bar;

FIG. 5 is a side view of the device illustrated in FIG. 1;

FIG. 6*a* is an enlarged, detailed side view of the coupling arrangement between a vertical support post and a horizontal support bar included in the device illustrated in FIG. 1;

FIG. 6*b* is a detailed side view of the device illustrated in 6*a* but wherein the horizontal support bar is disposed in an inoperative position;

FIG. 7 is a side view of a locking key for locking the horizontal support bar illustrated in FIG. 6*a* in its operative position;

FIG. 8 is a detailed side view of a baseball provided with a visual indicator in accordance with the subject invention;

FIG. 9 is a cross-sectional view of the baseball and cable illustrated in FIG. 8;

FIG. 10 is a partial cross-sectional side view of the ball as illustrated in FIG. 9 but further showing the means by which the ball supporting cable is attached to the horizontal support bar;

FIG. 11 is a perspective view of a batting practice device in accordance with an alternative exemplary embodiment of the invention;

FIG. 17 is a cross-sectional view taken along the line 17—17 of FIG. 11;

FIG. 18 is a cross-sectional view taken along the line 18—18 of FIG. 11;

FIG. 19 is a partial top view taken along the line 19—19 in FIG. 11;

DETAILED DESCRIPTION OF THE INVENTION

Figure 12:
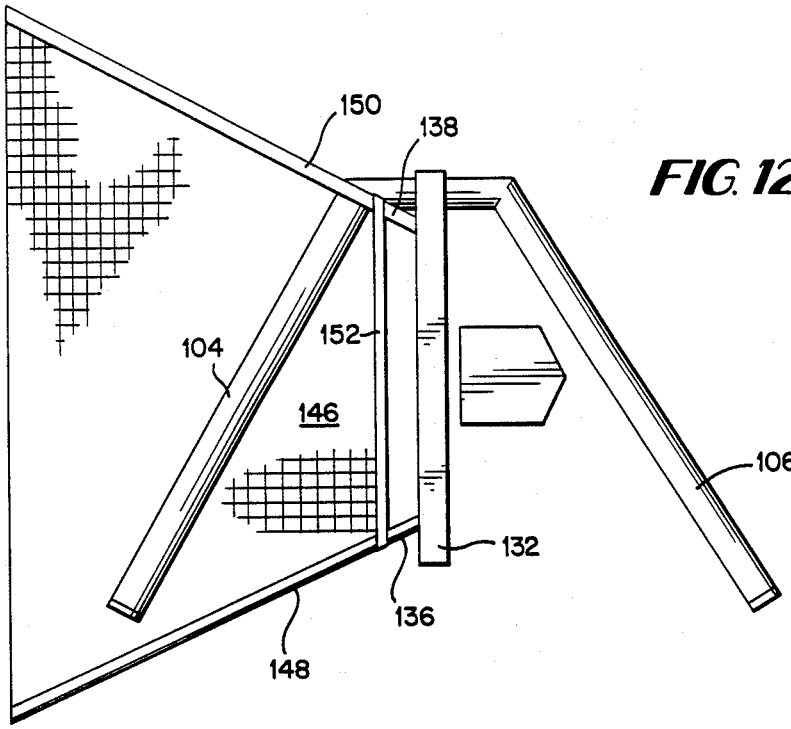
FIG. 12 is a top view of the device illustrated in FIG. 11, but drawn in partially schematic form.

With reference to FIGS. 1 through 5, a hitting practice device in accordance with a first exemplary embodiment of the invention will be described. The device 10, shown outfitted for baseball batting practice, includes an approximately square, tubular steel base structure 12 including a first C-shaped portion 14 which telescopes into a second "reverse" C-shaped portion 16 at joints 15, 17. In a preferred form, the base is approximately thirty-three inches square. Casters 18, 20 are provided at one end of the base structure, for example portion 14, so that the device can be tilted rearwardly onto the casters and rolled into the desired position.

The base structure mounts a vertical support post 22 which includes a vertical extension 24 slidably received therein for height adjustment purposes to be described in greater detail hereinbelow. A collar 26 is provided at the interface of post 22 and extensions 24 to insure a smooth sliding relationship therebetween. A key 28 attached to the post 22 by a chain 30 and retention device 31, is used to lock the extension 24 at the desired height by inserting the key in an aperture provided in the post 22 which is horizontally aligned with one of several apertures 32 provided in the extension 24, as illustrated in FIG. 1. The post 22 may be fixedly attached to the base structure 14 by any suitable means such as welding, or it may be removably attached as illustrated in FIG. 3 wherein the post 22 is slidably received over an upstanding tubular portion 23 and fixed to the base 12 and held in place by, for example, a key or thumb screw 25 inserted through post 22 and into engagement with the upstanding portion 22*a*.

An elongated support bar 34 is pivotally mounted as at 36 to the vertical extension 24. The details of the mounting arrangement at 36 will be discussed in detail in conjunction with FIGS. 6*a* and 6*b* further hereinbelow. In its operative position, elongated bar 34 is oriented generally perpendicularly with respect to support post 22 and extension 24, and lies in a vertical plane which, as shown in FIG. 2, essentially bifurcates the tubular support base 12.

A net supporting frame 38 is removably attached to the elongated bar 34. The net supporting frame includes a first member 40 and a second mirror-image member 42. The member 40 includes a portion 41 extending substantially parallel to bar 34, an angular portion 44 extending toward the bar 34 and which merges with a relatively short vertical section 46. The second member 42 includes a portion 43 extending substantially parallel to bar 34, an angular portion 48 extending toward the bar 34, and which merges with a relatively short vertical portion 50. One end of the first member 40 is received in an upstanding tubular stub 52 provided on the elongated bar 34, while one end of the second member 42 is received in a similar upstanding tubular stub 54 provided at the other end of the elongated bar 34. The other ends of first and second members 40, 42 are joined together, for example, by a nested or telescoped relationship at 45, so that the net supporting frame 38 in its assembled configuration has a substantially trapezoidal shape when viewed from above, as in FIG. 2.

It will be understood that the vertical support post 22, extension 24, support bar 34, frame 38 and stubs 52, 54 are preferably constructed of tubular steel or aluminum, commensurate with objectives of strength, light weight, and safety.

The net supporting frame 38 carries a relatively large, open mesh net 56, a major portion of which is substantially rectangular, and a minor portion of which is tapered. The net is supported in a cantilevered fashion with respect to the elongated bar 34. The net includes reinforced edges 58, 60, 62 and 64, portions of which are provided with grommets 66 by Which the net is attached to hooks, prongs, or any other suitable means provided on the net supporting frame 38 and elongated bar 34. It will be understood, of course, that any of a variety of conventional means may be utilized to attach the net to the net supporting frame.

It may thus be seen that the minor, tapered portion of the net extends generally horizontally away from the elongated bar 34, while the major, rectangular portion of the net extends vertically downwardly from the outer portion of the net frame toward the ground in a substantially vertical plane which is substantially parallel to, but laterally spaced from, the vertical plane in which the elongated bar 34 lies.

The elongated bar 34 also mounts a J-hook 68 from its underside at a point along its length substantially removed from the vertical support post 22 and associated extension 24. The J-hook 68 mounts a plastic coated, non-stretchable steel cable 70 via an eyelet 72 as best seen in FIGS. 1 and 10. The cable 70 is attached at its other end to a baseball or softball 74. The ball itself may be of the molded plastic type and dimpled about its exterior surface. Balls of this type are typically utilized in connection with automatic pitching machines. The ball is preferably made to size and weight specifications of official baseballs or softballs, whichever is desired. The ball 74 is further provided with a visual indicator 76, which in the preferred form, constitutes a fluorescent stripe (red or orange, for example) covering approximately the middle one-third of the ball. As previously mentioned, the visual indicator is designed to train the batters eyes to focus on the middle portion of a pitched ball and, in addition, to detect the spin of a pitched ball to reduce the time necessary to react to any given pitch.

Referring now to FIGS. 1, 6*a* and 6*b*, the attachment of elongated bar 34 to the vertical support post extension 24 will be described in detail. Vertical extension 24 is provided at its upper end with a slotted flange element 78 which receives therein a projecting element 80 formed at the inner end of the elongated bar 34. The bar 34 is pivotally mounted to the extension 24 by reason of a pin 82 extending between projection 80 and the slotted flange element 78. In addition, apertures 84 and 86 are formed in the projection 80 and upstanding flange element 78, respectively. By this arrangement, the elongated bar 34 may be moved to an operative position wherein the bar 34 extends substantially perpendicularly with respect to extension 24. In this position, the apertures 84, 86 are aligned and a key 28, shown in FIG. 7, may be inserted therethrough to lock the elongated bar 34 in its operative position.

To facilitate transport and/or storage, it will be understood that the net supporting frame 38 and net 56 may be disassembled from the elongated bar 34, and thereafter pin 28 removed so that elongated bar 34 may assume a second, inoperative position as partially illustrated in FIG. 6*b*, wherein bar 34 extends substantially parallel to the extension 24.

Further in this regard, it will be understood that base portion 12 may be disassembled into its component parts 14, 16; vertical support 22 (if attached in the manner disclosed in FIG. 3) may be disassembled from the supporting base 12; vertical extension 24 may be disassembled from vertical support post 22 so that the entire batting practice device, weighing less than forty pounds, may be disassembled and carried in a relatively small canvas bag or box, approximately 33 inches long, 24 inches wide and 18 inches high, for easy transport to various locations, or for compact storage.

Referring now to FIGS. 8 through 10, a detailed view of a baseball 74 provided with a visual indicator 76, and the connection between the ball 74 and cable 70 is shown. With respect to the latter, cable 70 extends through a bore 75 extending from the outer surface of the ball to its center, where the cable is anchored by means of a steel pin 92 extending through an eyelet (not shown) formed in the lower end of the cable 70, both of which are anchored within an inner core 90 of the molded plastic ball. In FIG. 10, there is more clearly shown the eyelet 72 by which the cable 70 is attached to the J-hook 68. Eyelet 72 is part of a sleeve 94 which is fastened to the cable 70 by any suitable means such as by crimping, individual fasteners and the like.

In its assembled state, the batting practice device is aligned adjacent home plate 96 as illustrated in FIG. 1. It will be understood that the arrangement in FIG. 1 is adapted for use by a left-handed batter, i.e., the net 56 is arranged forward of the batter, with the supporting base located to the left of home plate.

In order to adapt a device for use by a right-handed hitter, net supporting frame 38 and net 56 are removed from the elongated bar 34 and turned 180°, and reattached to the bar 34 so that the net 56 extends away from bar 34 in a direction opposite to that shown in FIG. 1. The batting practice device is then oriented to the right of home plate and is ready for use by a right-handed batter.

If it is desired to change the height of the ball to simulate pitches at a different level, for for different hitting drills, or to adapt the device for hitters of varying height, the key 28 may be removed and extension 24, along with bar 34, may be adjusted upwardly or downwardly as desired. Preferably, adjustments of bar 34 to heights of 7'6", 7' and 6'3" are achieved by appropriate placement of apertures 32 in the extension 24.

While the device illustrated in FIG. 1 has been described mainly for use with a baseball, it will be appreciated that a softball, or tennis ball may also be used to develop hitting skills in those respective sports.

Figure 14:
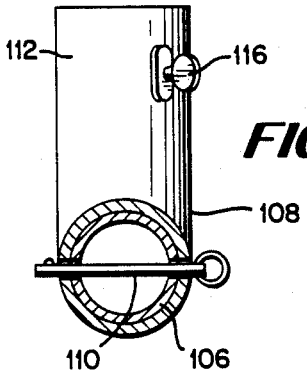
FIG. 14 is a partial cross-sectional view taken along the line 16—16 in FIG. 11.
Figure 15:
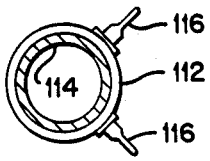
FIG. 15 is a cross-sectional view taken along the line 15—15 in FIG. 11.
Figure 16:
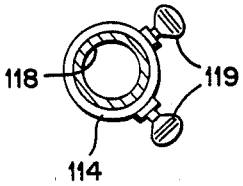
FIG. 16 is a partial detailed top view of the device illustrated in FIG. 11.
Figure 13:
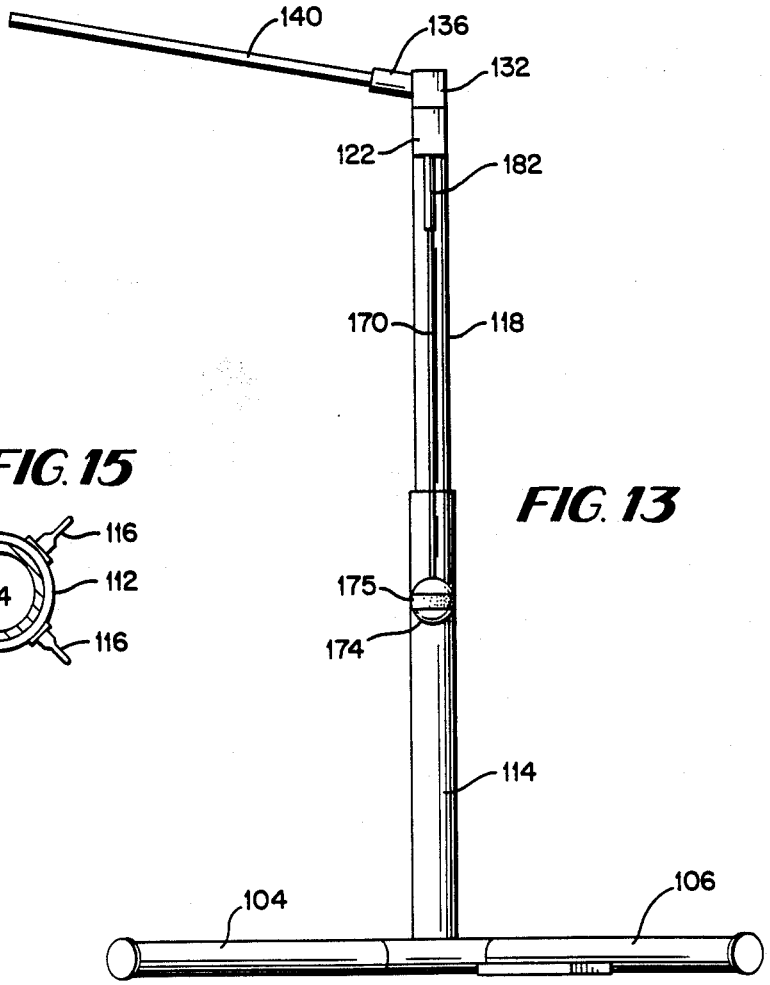
FIG. 13 is a side view of the device illustrated in FIG. 11.

With reference now to FIGS. 11–22, an alternative embodiment of the invention will be described in detail. In this alternative embodiment 100, a generally truncated V-shaped steel or aluminum base 102 is provided which includes a first leg portion 104 and a second leg portion 106 extending angularly away from a T-joint coupling 108. It will be understood that leg portions 104 and 106 nest or telescope together within the horizontal portion of coupling 108 and are secured together by pin or key 110 as best seen in FIG. 14. A vertically oriented, tubular support post 114 extends upwardly from a vertical stem portion 112 of the T-joint coupling 108. The support post 114 is secured to the coupling portion 112 by means of thumb screws 116 which can best be seen in FIGS. 14 and 15. As in the first embodiment, the vertical support post includes a vertical extension 118 telescopically received within the support 114 for adjusting the height of the ball, and for adapting the practice device to users of varying heights. In this embodiment, however, adjustment of the extension 118 with respect to the support post 114 is accomplished, as shown in FIG. 16, by means thumb screws 119 which extend through the support post 114 and into engagement with the extension 118.

At the upper end of the vertical extension 118 there is fixedly secured, by welding or other suitable means, a U-shaped bracket 120, leg portions of which extend away from the extension 118. The U-shaped bracket mounts an elongated support bar 122 which, in its operative position, extends substantially perpendicularly with respect to the vertical extension 118 and lies in a vertical plane which substantially bifurcates the base structure 102. The elongated bar 122 is mounted within the U-shaped bracket 120 in the manner illustrated in detail in FIG. 17. A nut and bolt assembly 124 pivotally mounts the bar 122 within the bracket 120. A key element or pin 126 is insertable through the U-shaped bracket and the support bar to lock the bar in its operative position. It will be understood that by removing the key 126, the bar 122 is free to pivot downwardly into an inoperative position, substantially parallel with the support post 114 and extension 118.

At its opposite end, the elongated support bar 122 mounts an upwardly extending tubular bushing 128 which telescopically receives a slightly larger tubular bushing 130 provided on the underside of an elongated, net supporting member 132, as best seen in FIG. 18. A key 134 is insertable within apertures provided in the bushings 128, 130, respectively, to hold the net supporting member 132 in generally parallel alignment with the elongated support bar 122.

Net supporting member 132 includes a pair of angularly oriented tubular stub elements 136, 138 into which are inserted tubular net supporting extensions 140, 142. These extensions are detachably secured within the bushings 136, 138 by means of thumb screws 144, one of which is shown in FIG. 19.

The partially tapered net 146 is provided with reinforced sleeve portions 148, 150 along its side edges which may be slidably pushed over the extensions 140, 142 to mount the net in the manner illustrated in FIG. 11, where a minor, tapered portion extends horizontally away from the net supporting frame 132, and a major, rectangular portion of the net extends vertically downwardly toward the ground in a vertical plane substantially parallel to the vertical plane in which the elongated support bar 122 and net frame 132 lie. The net 146 is further provided with reinforced top and bottom edges 152 and 154, respectively. It will be appreciated that edge 152 may be provided with grommets for attachment to hooks or the like on member 132 to further secure the net to the support structure.

Figure 20:
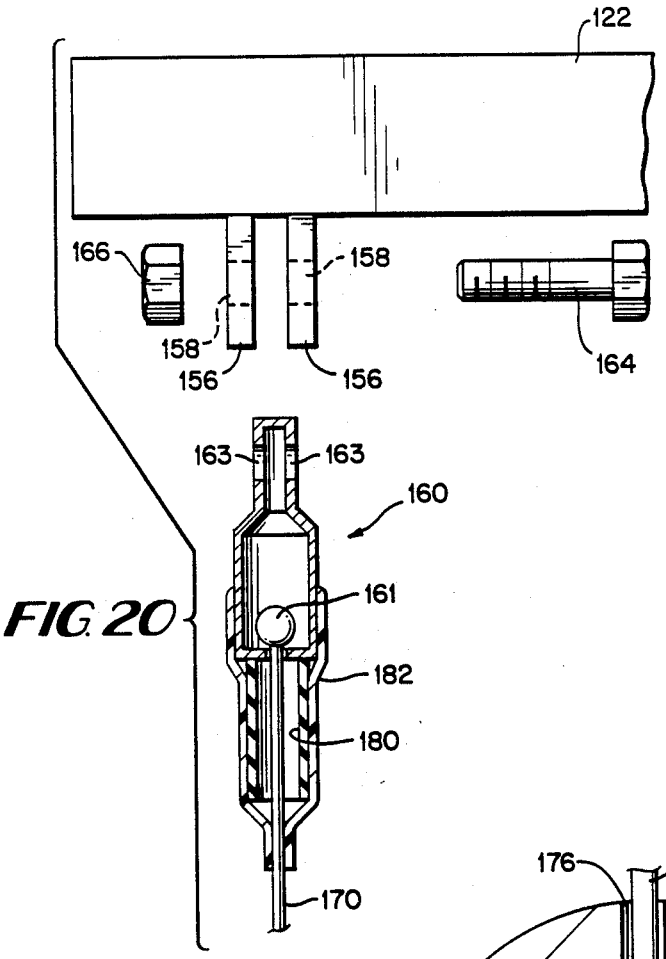
FIG. 20 is a partially cross-sectional side view illustrating mounting structure on the horizontal support bar for suspending a ball in accordance with the invention.
Figure 21:
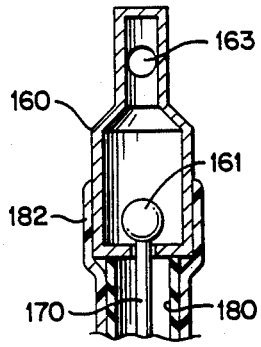
FIG. 21 is a partial, cross-sectional detail of a swivel attachment shown in FIG. 20.

With specific reference to FIGS. 20 and 21, it may be seen that the elongated support bar 122 is provided at its outer end with a pair of depending prongs 156 which are formed with horizontally aligned apertures 158. A swivel attachment 160 formed with aligned apertures 163, may be received between the prongs and releasably secured thereto by means of a screw 164 and nut 166. The swivel attachment 160 mounts one end of a plastic-coated, steel cable 170, formed with an enlarged head 161 which supports a ball 174 in suspended relationship with respect to the elongated support bar 122. By this arrangement, cable 170 and ball 174 are permitted to swivel, or spin about an axis generally defined by the cable itself.

In a further aspect of the present invention, a rubber sleeve 180, which may comprise a section of a conventional rubber garden hose for example, is located at the upper end of cable 170, the upper edge of which is in engagement with swivel attachment 160. A second sleeve or film 182 of thermoplastic material is heat shrunk about the sleeve 180 and swivel 160 to hold the sleeve 180 in place.

In operation, the sleeve 180 and shrunk film 182 are effective to further dampen the kinetic energy of the ball, and in conjunction with the net construction, results in a turnaround time of only 3–4 seconds between hittable "pitches".

Figure 22:
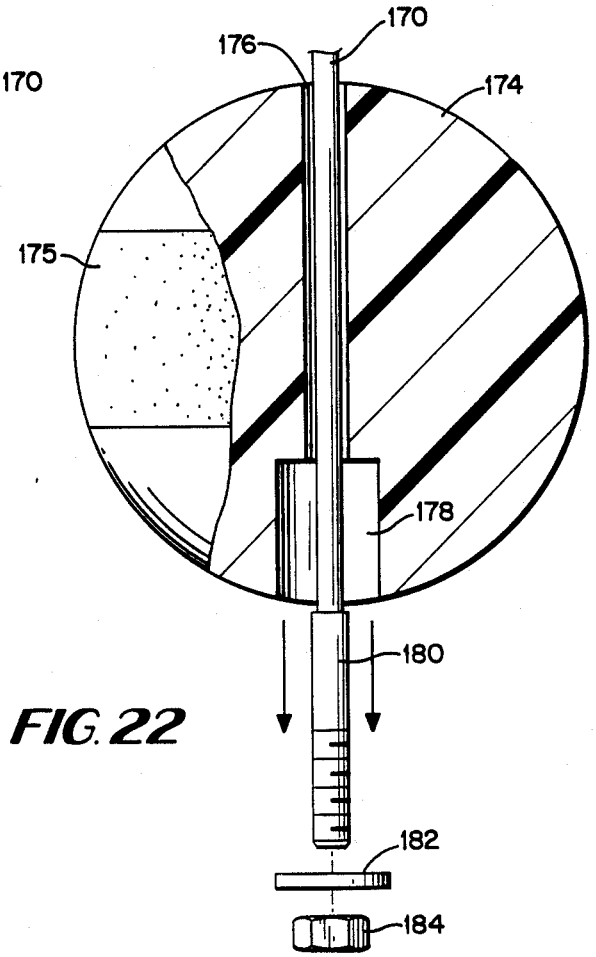
FIG. 22 is a partial cross-sectional view of the ball and cable attachment arrangement in the second exemplary embodiment of the invention.

With reference now to FIG. 22, it may be seen that the cable 170 extends through a bore 176 provided in the ball 174. The bore terminates in a countersunk portion 178 at the lower end of the ball. Cable 70 is provided at its lower end with a threaded sleeve 180 which receives a washer 182 and a nut 184. The size of the countersunk portion 178 is such that the washer and nut will be totally enclosed with the countersunk portion and thereafter, an epoxy composition is utilized to fill the countersink portion. Once cured, the epoxy may be sanded down so that the ball 174 presents a flush, rounded surface in the area of the countersunk portion 178.

As in the previously described embodiment, ball 174 is provided with a stripe 175 about the middle one-third thereof. Again, the stripe is preferably of a fluorescent color, such as red or orange, to provide a striking visual indicator to the hitter of that part of the ball which it is most desired to hit.

With this second embodiment, as in the first embodiment, the tubular components are preferably steel or aluminum, and the entire device may disassembled at the variously described joints for ease of transport and/or storage. In addition, merely by removing the pin 128, the net supporting frame 132 may be swung about the elongated support bar 122 approximately 180° so that the batting practice device may be easily adapted for use with either a left-handed or right-handed batter.

The nets 56, 146, are custom designed for use with the present invention. This is because the nets must be heavy enough not to flip back over the top of the device when hit, or during light to moderate wind conditions. On the other hand, it is desirable that the net move forwardly to some extent when hit so as to insure no interference during follow through by the batter. Moreover, the mesh size of the net must be as large as possible to maximize the absorption of the kinetic energy of the ball, but not so large as to let the ball escape, or pass through the net. The preferred mesh size is $1\frac{3}{4}$ inches for use with a regulation size baseball, but this size mesh opening works well with softballs and tennis balls as well.

With respect to both embodiments, it will be understood that, when properly oriented with respect to home plate on a baseball field, the left and right vertical side edges of the net correspond to the foul lines of a baseball field as indicated by the dotted lines FL in FIG.

2. This arrangement provides clear indication to the batter of whether or not the struck ball would have been fair or foul under game conditions.

While the invention has been described in connection with what is presently considered to be the most practical and preferred embodiments, it is to be understood that the invention is not to be limited to the disclosed embodiment, but on the contrary, is intended to cover various modifications and equivalent arrangements included within the spirit and scope of the appended claims.

I claim:

1. A ball hitting practice device comprising:

(a) a supporting base;

(b) an upstanding, substantially vertical support post;

(c) a substantially horizontal support bar mounted at an upper end of said vertical support bar, said horizontal support bar lying in a first vertical plane substantially bifurcating said supporting base;

(d) a net supported by said horizontal bar and cantilevered therefrom such that a minor portion of said net extends substantially horizontally away from said bar and a major portion of said net extends in a second substantially vertical plane parallel to and laterally spaced from said first vertical plane, and (e) a ball suspended from said horizontal support bar.

2. A practice device as defined in claim 1 wherein said minor portion of said net is supported by a pair of arms detachably connected at first ends to said horizontal support bar, and detachably connected at second ends to each other.

3. A practice device as defined in claim 2 wherein said horizontal support bar is mounted to said vertical support post for selective pivotal movement between a first operative position and a second, inoperative position facilitating storage and transport.

4. A practice device as defined in claim 1 wherein said minor portion of said net is supported by a pair of arms detachably connected to an elongated member mounted to said horizontal support bar, said member being selectively pivotable to orient said net in operative positions on either side of said horizontal support bar so that said device is adaptable to both right- and left-handed batters.

5. A practice device as defined in claim 4 wherein said horizontal support bar is mounted to said vertical support post for selective pivotal movement between a first operative position and a second, inoperative position facilitating storage and transport.

6. A practice device as defined in claim 4 wherein said elongated member is provided with oppositely angled tubular stubs adjacent either end of said member, each of said stubs adapted to receive one of said pair of arms, said elongated member further provided with means intermediate the ends thereof for detachably coupling said member to said horizontal support bar, and including means for locking said member in either of said operative positions.

7. A practice device as defined in claim 1 wherein said base comprise's a closed loop tubular structure.

8. A practice device as defined in claim 1 wherein said base comprises a pair of tubular leg portions extending away from each other in a generally V-shaped configuration.

9. A practice device as defined in claim 1 wherein said vertical support post includes at least a pair of tubular members, one of which is telescopically received in the other, and wherein adjustment means are provided for securing said one tubular member at different positions with respect to said other tubular member.

10. A practice device as defined in claim 1 wherein said ball is provided with visual indicator means to facilitate hitting of the ball by a user of the device.

11. A practice device as defined in claim 10 wherein said visual indicator means includes a stripe about the middle portion of said ball.

12. A practice device as defined in claim 11 wherein said ball has the size and weight of a regulation baseball.

13. A practice device as defined in claim 11 wherein said ball has the size and weight of a regulation softball.

14. A practice device as defined in claim 11 wherein said ball has the size and weight of a regulation tennis ball.

15. A practice device as defined in claim 1 wherein said ball is suspended from said horizontal support bar by cable means provided with means for damping the kinetic energy of a struck ball.

16. A practice device comprising:

(a) a support stand;

(b) a vertical support post adjustably mounted to said support stand;

(c) a support bar pivotally mounted at one end to said vertical support post;

(d) a net supporting frame detachably secured to said support bar; said frame being movable between two positions, approximately 180° apart, so that said batting practice device may be utilized by both right-handed and left-handed batters; and (e) a regulation baseball suspended from said support bar and adapted to be hit into said net, and wherein said baseball is provided with visual indicator means for assisting a batter to hit said ball.

17. A practice device as defined in claim 16 wherein said support bar is pivotally mounted to said vertical support post for movement between a first operative position wherein said support bar extends substantially perpendicularly with respect to said vertical support post, to a second inoperative position wherein said support bar extends substantially parallel to said vertical support post.

18. A practice device as defined in claim 16 and including means for supporting said net in a cantilevered arrangement with respect to said support bar in said first operative position such that a minor portion of said net extends substantially horizontally away from said support bar, and a major portion of said net extends substantially vertically in laterally spaced relationship with respect to said baseball.

19. A practice device as defined in claim 16 wherein said visual indicator means includes a stripe about a middle portion of said baseball.

20. A practice device as defined in claim 19 wherein said stripe extends about the middle one-third of the ball, and wherein said stripe is a fluorescent color.

21. A batting practice device as defined in claim 18 wherein said baseball is suspended from said support bar by cable means provided with kinetic energy damping means.

22. A practice device comprising:

(a) a ground engaging support stand;

(b) a vertical support post removably attached to said support stand, said vertical support post including means for adjusting the vertical extent thereof;

(c) a supporting bar pivotally attached to said vertical support for movement between a first operative position wherein the bar extends substantially horizontally, to a second, inoperative position wherein the bar extends substantially vertically;

(d) a net supporting frame detachably secured to said support bar; said frame being movable between two positions, approximately 180° apart, so that said batting practice device may be utilized by both right-handed and left-handed batters; and supporting bar.

23. A practice device as defined in claim 22 wherein said ball and said cable are adapted to swivel about a vertical longitudinal axis of rotation extending through said cable in its normal, suspended position.

24. A practice device as defined in claim 22 wherein said cable terminates at its upper end in a swivel coupling attached to said supporting bar.

25. A practice device as defined in claim 22 and further including a first sleeve mounted over said cable at said upper end, said first sleeve being held at said upper end by a second sleeve applied over said first sleeve and engaging said swivel coupling at one end and said cable at the other end.

26. A practice device as defined in claim 22 wherein said ball has the size and weight of a regulation baseball.

27. A practice device as defined in claim 22 wherein said ball has the size and weight of a regulation softball.

28. A practice device as defined in claim 22 wherein said ball has the size and weight of a regulation tennis ball.

29. A practice device as defined in claim 22 wherein said net has a mesh opening size of $1\frac{3}{4}$ inches square.

* * * * *